US005972130A

United States Patent [19]

Underys et al.

[11] Patent Number: 5,972,130

[45] Date of Patent: Oct. 26, 1999

[54] HIGH IMPACT AND THERMAL SHOCK RESISTANT DIE STEEL, DIES, DIES BLOCKS AND METHOD OF MANUFACTURE THEREOF

[75] Inventors: Algirdas A. Underys, Arlington Heights; Charles W. Finkl, Evanston, both of Ill.

[73] Assignee: A. Finkl & Sons Co., Chicago, Ill.

[21] Appl. No.: 08/901,613

[22] Filed: Jul. 28, 1997

[51] Int. Cl.[6] ..... C22C 38/44

[52] U.S. Cl. ..... 148/335; 148/332; 148/333; 420/91; 420/108

[58] Field of Search ..... 148/332, 335, 148/333; 420/91, 108

[56] References Cited

U.S. PATENT DOCUMENTS

| | | | |
|---|---|---|---|
| 4,226,645 | 10/1980 | Wald et al. . | |
| 5,059,389 | 10/1991 | Finkl | 420/67 |
| 5,129,966 | 7/1992 | Rao . | |
| 5,454,883 | 10/1995 | Yoshie et al. | 148/320 |

*Primary Examiner*—John Sheehan

*Attorney, Agent, or Firm*—James G. Staples; A. Finkl & Sons Co.

[57] ABSTRACT

A steel and tool made therefrom which in a tempered condition of 388 BHN or softer has high strength, high wear resistance together with excellent toughness in the range of 15% elongation and 35 ft-lbs. charpy and having the following composition:

| | |
|---|---|
| C | .33–.39 |
| Mn | .50–.70 |
| P | .025 max. |
| S | .025 max. |
| Si | .40–.60 |
| Ni | 1.05–1.35 |
| Cr | 1.33–1.68 |
| Mo | .40–.60 |
| Cu | .60–.90 |
| Al | .010–.030 |
| Fe | balance |

20 Claims, 6 Drawing Sheets

HIGH IMPACT AND THERMAL SHOCK RESISTANT DIE STEEL, DIES, DIES BLOCKS AND METHOD OF MANUFACTURE THEREOF

This invention relates generally to die steel and the various processed forms it takes, including die blocks and dies, and a method of manufacturing the same. It is specifically concerned with such products which possess surprisingly high strength and wear resistance properties together with excellent toughness at all hardness ranges.

BACKGROUND OF THE INVENTION

The invention pertains to steel and shaped forms thereof which are subjected to extremely rugged service conditions. For convenience of description the invention will be described in terms of die steels and tools, including die blocks and dies, used in forging and related metal shaping operations such as punches, headers and sizing mandrels. As is well known, these applications, including particularly closed die hot work implements, such as press dies and hammer dies, represent some of the most, if not the most, rugged and demanding operating conditions in the entire field of metal shaping and forming.

Referring now specifically to a closed die forging implement such as hammer die, it is axiomatic that such implements must possess high strength and high wear resistance at the elevated temperatures which are encountered in their usual working environments together with great toughness. It is also axiomatic, until this invention, that the properties of high strength and high wear resistance, on the one hand, and high toughness on the other hand, were mutually incompatible to a large extent. Thus, the closed die forger desires high strength and high wear resistance in order to obtain as many thousands of parts from an impression in the die surfaces so that the forging cost per part is minimized to the greatest extent possible. In order to obtain high strength and high wear resistance it has been thought necessary, prior to this invention, that toughness had to be sacrificed to some extent, since the alloy elements which produce high strength and high wear resistance, such as carbon, tend to result in lower toughness. Toughness is used herein in the sense of ductility and deformability under load without cracking.

For applications in which the formed or shaped workpiece has a relatively simple contour such as a link, the sacrifice of toughness in exchange for high strength and high wear resistance, which yields long runs, is not of great concern. However, for applications in which the shaped or formed workpiece is complex in contour, the die steel must have excellent toughness to preclude premature fracture of the tool, and, as mentioned, it has been thought that an increase in toughness is accompanied by a drop in strength and wear resistance, and a consequent decrease in production with its concomitant increase in die cost per piece.

It has been proposed that the ability to have high strength, high wear resistance and excellent toughness can be achieved by the use of appropriate alloying materials, and compositions with these characteristics have been proposed and used. Such compositions however almost invariably have substantial quantities of expensive alloys, such as nickel, and thus the apparent functional advantages derived form the use of alloys is substantially offset by the increased cost with the result that the goal of an economical, high strength, high wear resistance, metal shaping tool with excellent toughness is not available, particularly in those applications which require relatively soft tempered material.

In this connection, and as a frame of reference, tempers will be used in a definitional sense. For ease of understanding in the specifications and claims, the numeric definition of temper levels, in terms of currently widely used industry hardness standards, will be used.

| Temper | BID | BHN | Rc |
|---|---|---|---|
| XH (Extra Hard) | 2.65–2.75 | 534–495 | 54–51 |
| H (Hard) | 2.80–2.90 | 477–444 | 50–47 |
| 1 | 2.95–3.05 | 429–401 | 46–43 |
| 2 | 3.10–3.25 | 388–352 | 42–38 |
| 3 | 3.30–3.45 | 341–311 | 37–33 |
| 4 | 3.50–3.65 | 302–277 | 29–32 |
| Annealed | 3.80 | 255 | 25 |

SUMMARY OF THE INVENTION

The invention in its most basic form is a die steel which hardens deeply and uniformly due to its alloy formulation, but in particular to the beneficial effects of copper, and is therefore an economical alternative to the conventional higher nickel formulations in the temper 2 and higher tempers. Specifically, the die steel has high temperature tensile strength that is superior to traditional hot work die steels, which characteristic is believed to be due to the precipitation strengthening effects of copper and molybdenum precipitates. Further, though it has approximately the same ductility as a currently highly regarded die steel of significantly higher alloy content, the new steel has (1) the same hardenability as the reference steel; i.e.: it hardens deeply and uniformly and holds up exceedingly well under impact and thermal shock, but (2) significantly higher charpy values. The new steel will therefore meet or exceed the performance of the reference steel at a hardness below 388 BHN while providing a significant die material cost savings.

BRIEF DESCRIPTION OF THE DRAWING

The invention is disclosed, more or less diagrammatically and representationally, in the accompanying drawing wherein.

DETAILED DESCRIPTION OF THE INVENTION

Figure 1:
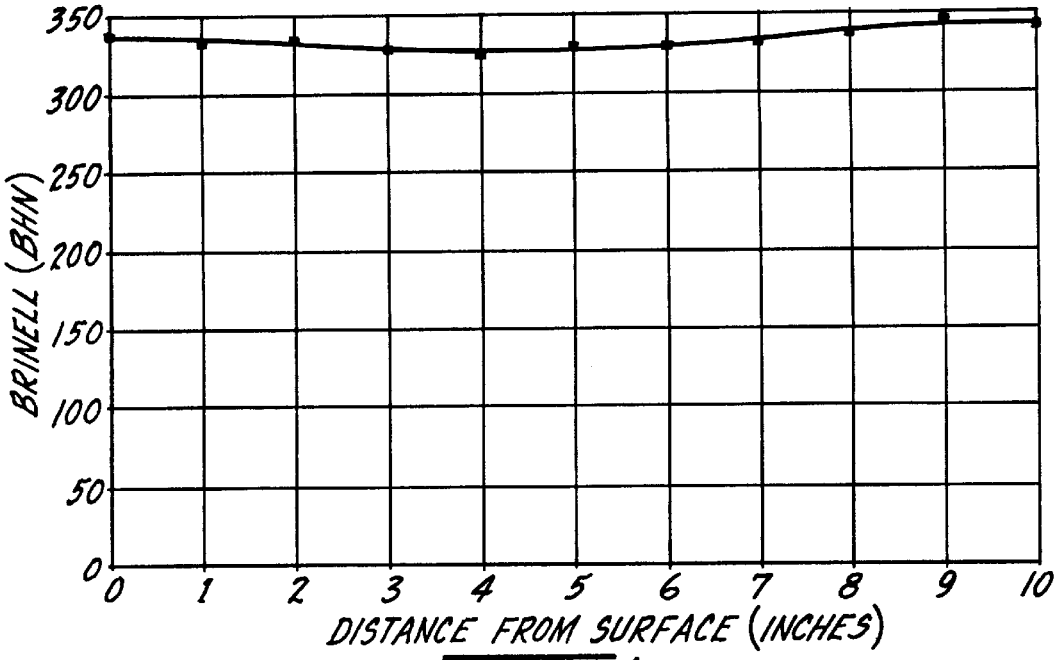
FIG. 1 is a hardness traverse across a block of the invention steel.

The steel of this invention has the following composition in weight percent.

| | Preferred | Broad |
|---|---|---|
| C | .33/.39 | .25/.45 |
| Mn | .50/.70 | .50/1.50 |
| P | .025 max. | .025 max. |
| S | .025 max. | .025 max. |
| Si | .40/.60 | .30/.70 |
| Ni | 1.05/1.35 | .40/1.40 |
| Cr | 1.33/1.68 | 1.25/1.75 |
| Mo | .40/.60 | .30/.70 |
| Cu | .60/.90 | .60/1.50 |
| Al | .010/.030 | 0.10/.10 |
| Fe | balance | balance |

If carbon is less than 0.25 the required strength and wear resistance will not be achieved. Carbon levels above 0.45 decrease the precipitation hardening effect of copper, and, further, carbon lowers the solubility of copper in liquid iron. The foregoing properties are best balanced in the preferred range and, within that range, an aim of 0.36 is close to ideal.

Manganese is present in an amount somewhat higher than is usual in steels of this type because, in addition to its strong contribution to hardenability, it increases the solubility of copper in liquid iron, which is a very desirable effect. It is also necessary as a deoxidizer in the steel making process. If less than 0.50 is present the effects of elimination of hot shortness due to manganese sulfide formation and increase in machinability will not be attained to the necessary degree. If more than 1.50 is present, too much austenite may be retained and ductility will be adversely affected. The foregoing properties are best balanced in the preferred range and, within that range, an aim of 0.60 is close to ideal.

Phosphorus aids machinability by facilitating chip breakage. However phosphorus above 0.025 is detrimental to physical properties such as ductility and impact strength in this steel. Phosphorus should be held at as low a level as possible, not exceeding 0.025.

Sulphur aids machinability by facilitating chip breakage. However sulphur above 0.025 is detrimental to physical properties such as ductility and impact strength in this steel. Despite these drawbacks however sulphur serves a useful function within the above constraints, and an aim of 0.010 is appropriate.

Silicon is a moderate contributor to hardenability and is an excellent deoxidizer in the steel making process. Silicon increases the time required for the same level of precipitation hardening. Silicon also performs the very useful function, in this steel, of increasing the solubility of copper in liquid iron. The foregoing advantageous properties are best balanced in the preferred range, and, within that range, an aim of 0.50 is close to ideal.

Nickel has the highly desirable ability in this steel of increasing the solubility of copper in liquid iron. Nickel is also a necessity for controlling surface cracking during forging, and it is a modest contributor to hardenability. While nickel has very desirable attributes it is currently very high priced and hence the use of more than 1.40 nickel makes the invention steel non-competitive from a cost standpoint. However, at least 0.40 nickel is required to raise the melting point of the copper rich alloy that forms on the surface of the workpiece during heating and forging. The foregoing advantageous properties are best balanced in the preferred range and, within that range, an aim of 1.20 is close to ideal.

Chromium contributes significantly to hardenability of this alloy. Chromium carbides are beneficial for increased wear resistance. Chromium also increases the resistance to softening at elevated temperatures and contributes to high temperature strength. The foregoing advantageous properties are best balanced in the preferred range and, within that range, an aim of 1.50 is close to ideal.

Molybdenum improves the impact resistance of this copper bearing steel and this characteristic is especially important if the material is to be used as a forging die. Molybdenum carbides are beneficial for increased wear resistance, and molybdenum significantly raises the high temperature strength. The foregoing advantageous properties are best balanced in the preferred range and, within that range, an aim of 0.50 is close to ideal.

When present in a sufficient amount, copper, in this steel, causes the steel to respond to precipitation hardening when re-heated to 800° to 1200° F. Copper also increases the fluidity of the steel in a molten condition. Specifically, 1% copper has the same effect on molten steel fluidity as a 125° F. rise in temperature. Copper improves mechanical properties such as yield to tensile ratios, ductility, impact resistance, machinability and corrosion resistance. It also increases hardness. The maximum solubility of copper in iron at room temperature when quickly cooled, which is the preferred cooling procedure, is 1.50. Thus, and since hardness increases are negligible for copper contents greater than 1.50, this quantity is the upper limit. Since at least 0.60 copper is necessary to cause the above described response to precipitation when re-heated, 0.60 is the lower limit. The foregoing advantageous properties are best balanced in the preferred range, and within that range, an aim of 0.75 is close to ideal.

Aluminum is important as a de-oxidizer in the steel making process. It also restricts austenite grain growth and thereby functions as a grain refiner. In forging applications, and many others as well, fine grain is a highly desirable attribute. Aluminum, in this copper rich steel, also appears to improve the notch impact strength. Since undesirable effects, such as increasing the level of detrimental oxides, will appear if too much aluminum is present, the upper limit of aluminum is 0.10. The above described advantageous properties may not be realized if less than about 0.010 is present and hence this is the lower limit. The foregoing advantageous properties are best balanced in the preferred range and, within that range, an aim of 0.020 is close to ideal.

The processing of the steel is essential to its satisfactory performance in the wide range of applications in which it is utilized. Specifically, the steel should have as low an inclusion content as possible, and should have hydrogen, oxygen and nitrogen in only low, controlled amounts. To ensure obtaining the above described advantageous characteristics, and others relating to inclusion shape control and gaseous morphology, the steel must be vacuum treated under carefully controlled conditions.

To achieve these ends the steel, in batches ranging from 50 tons or smaller up to about 150 tons, but preferably in the 60–70 tons range, are subjected in molten condition to a vacuum of on the order of about 1–100 mm Hg and simultaneously subjected to the upward passage of a purging gas to ensure flushing of inclusion forming impurities and undesirable quantities of hydrogen, oxygen and nitrogen out of the steel. Since as is well known in the art (see for example U.S. Pat. No. 3,635,696, Addition of highly deoxidizing alloys such as Al or Si may advantageously be made late in the cycle to minimize inhibition of $O_2$ removal by the carbon monoxide reaction in the melt. Col. 3, Lines 57–60, U.S. Pat. Nos. 4,069,039, 4,328,739, 4,468,249 and 4,600,427, aluminum additions would be burned out if added too early in the treatment process, they must be added late in the process since close control of the teeming temperature is essential to ensure proper ingot solidification in bottom poured molds, the molten steel, during at least part of the time it is subjected to the vacuum and purging gas, should be simultaneously subjected to an alternating current heating are struck from graphite electrodes directly to the heat. A convenient and commercially available and practical treatment system and method (which also controls the sulphur content) is disclosed in U.S. Pat. Nos. 3,236,635 and 3,501,289, the disclosures of which are incorporated herein by reference to avoid prolixity.

The advantageous features of the invention are more graphically seen from the following investigations.

A trial heat of the invention steel was formulated as set out below.

TABLE 1

| | Actual |
|---|---|
| C | .34 |
| Mn | .60 |
| P | .003 |
| S | .003 |
| Si | .56 |
| Ni | 1.18 |
| Cr | 1.53 |
| Mo | .50 |
| V | .06 |
| Cu | .67 |
| Al | .027 |

The test material was cast into a 3 inch diameter ingot, and weighed approximately 16 pounds. The material was heated to 1922° F. (1050° C.) and extruded into a 1 inch diameter rod (approximately 9 to 1 reduction).

Four groups of tensile and charpy blanks were prepared and heat treated. All four groups were austenitized at 1650° F. for one hour and then tempered. One group was tempered at 900° F., a second at 1000° F., a third at 1100° F., and the last group at 1200° F. The testing results can be found in Table 2.

TABLE 2

| | BID | BHN | Yield | UTS | RA | Elong. | Charpy | Charpy avg. |
|---|---|---|---|---|---|---|---|---|
| 900° F. | 2.90 | 444 | 180900 | 216250 | 38.85 | 12.5 | 15.5, 14 | 15 |
| 1000° F. | 3.00 | 415 | 168869 | 204680 | 41.49 | 13.5 | 21.5, 20.5 | 21 |
| 1100° F. | 3.10 | 388 | 163918 | 190179 | 45.97 | 14.50 | 35, 37 | 36 |
| 1200° F. | 3.40 | 321 | 139306 | 160182 | 55.11 | 17.5 | 63, 63 | 63 |

The low carbon yielded good ductility and toughness of the alloy as can be seen in the above table. However, the lower carbon limited the maximum hardness attainable with this alloy formulation.

To verify the affect of carbon, a second trial heat was made as set out below:

TABLE 3

| | Actual |
|---|---|
| C | .42 |
| Mn | .69 |
| P | .004 |
| S | .004 |
| Si | .53 |
| Ni | 1.20 |
| Cr | 1.44 |
| Mo | .50 |
| V | .06 |
| Cu | .71 |
| Al | .040 |

The test material was cast into a 3 inch diameter ingot, and weighed approximately 16 pounds. The material was heated to 1922° F. (1050° C.) and extruded into a 1 inch diameter rod (approximately 9 to 1 reduction).

Three groups of tensile and charpy blanks were prepared and heat treated in the lab. All three groups were austenitized at 1650° F. for one hour and then tempered. One group was tempered at 1000° F., a second at 1100° F., and the last group at 1200° F. The testing results can be found in Table 4.

TABLE 4

| | BID | BHN | Yield | UTS | RA | Elong. | Charpy | Charpy avg. |
|---|---|---|---|---|---|---|---|---|
| 1000° F. | 2.90 | 444 | 172810 | 221656 | 21.06 | 10.0 | 12.5, 13.5 | 13 |
| 1100° F. | 3.10 | 388 | 163918 | 190179 | 45.97 | 14.5 | 35, 37 | 36 |
| 1200° F. | 3.25 | 352 | 148548 | 172130 | 43.19 | 14.0 | 44, 43 | 43.5 |

As can be seen from the test data, the first lower carbon trial heat had superior ductility to the second trial heat. The additional carbon in the second trial heat decreased the precipitation hardening affect of copper, thereby nullifying some of the physical property improvements. A comparison of the two trial heats at the same hardness can be found in Table 5 below.

TABLE 5

| | Tempering Temperature | BID | BHN | Yield | UTS | RA | Elong. | Charpy avg. |
|---|---|---|---|---|---|---|---|---|
| Trial 1 | 900° F. | 2.90 | 444 | 180900 | 216250 | 38.85 | 12.5 | 15 |
| Trial 2 | 1000° F. | 2.90 | 444 | 172810 | 221656 | 21.06 | 10.0 | 13 |

To evaluate the actual shop produced physical properties of the new steel, a test block was forged, heat treated, and tested. The test block was forged 10"×10"×15", which is the same cross-section as test blocks that have been used to evaluate other well known proprietary grades. The test block had a chemical composition similar to the first (lower carbon) trial heat. The chemical analysis for this can be found in Table 6:

TABLE 6

| | Trial 1 | Heat #260171 |
|---|---|---|
| C | .34 | .38 |
| Mn | .60 | .59 |
| P | .003 | .009 |
| S | .003 | .007 |
| Si | .56 | .50 |
| Ni | 1.18 | 1.39 |
| Cr | 1.53 | 1.46 |
| Mo | .50 | .52 |
| V | .06 | .07 |
| Cu | .67 | .81 |
| Al | .027 | .017 |

The 10"×10"×15" test block was austenitized by heating to 1650° F., water quenching, and then tempering at 1130° F.

The physical testing samples were obtained from a one inch slice taken from the center of the test block in the transverse direction. Tensile samples that represented the center of the test block in the transverse direction were evaluated and compared to the transverse properties of said competitive steel from test blocks of the same cross section and processed at approximately the same tempering temperature. The tensile results can be found in Table 7.

TABLE 7

| | Invention Steel | Standard Steel No. 1 | Standard Steel No. 2 |
|---|---|---|---|
| Yield strength (psi) | 136,050 | 144,000 | 162,000 |
| Ultimate strength (psi) | 156,800 | 159,000 | 174,000 |
| Elongation - 2 inch gauge length | 11.0% | 2.5% | 8.0% |
| Reduction of Area | 15.0% | 5.4% | 15.9% |
| Tensile sample hardness (BID) | 3.36/3.36 | 3.30/3.25 | 3.20/3.20 |

Three charpy impact specimens were obtained from the center of the hardened test block, in the transverse direction, and were compared to the transverse impact properties of standard steel 1 from test blocks of the same cross-section and processed at the same tempering temperature. The results can be found in Table 28. The invention steel specimens exhibited a ductile fracture face.

TABLE 8

| | Invention Steel | Standard Steel No. 1 | Standard Steel No. 2 |
|---|---|---|---|
| Charpy Impact @ Room Temperature | 35-31-33 avg. = 33.0 | 9-9-8 avg. = 8.7 | 23-22-21 avg. = 22.0 |
| Hardness (HRc) | 36 | 37 | 38 |

A hardness traverse was performed across the thickness of the test block. The results can be found in FIG. 1. The hardness drop-off is approximately 0.05 BID, verifying the hardenability affect of copper in this formulation.

Seventeen samples of invention steel chemistry were sawed from the test block. These samples were turned to 1 inch diameter rounds, austenitized at 1650° F. for one hour at temperature, oil quenched, and then tempered at various temperatures. Three samples (that were chosen at random) were tempered at 1000°, 1100°, and 1200° for charpy impact and tempering response testing. Six additional samples were tempered at 600°, 900° F., 1000°, 1100°, 1200°, and 1300° for tensile and tempering response testing. The remaining eight samples were tempered at 1100° and 1200° F. (four samples at each temperature) for hot tensile testing.

Figure 2:
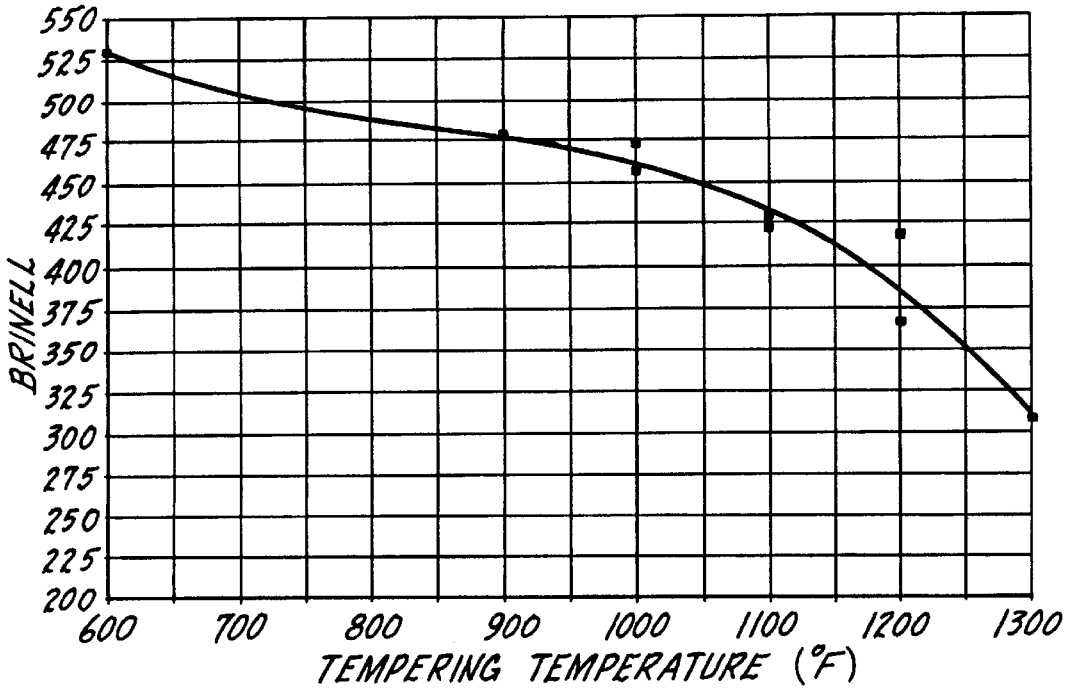
FIG. 2 is a tempering response curve over a 600° F. to 1300° F. tempering range of the invention steel.

The nine samples to be used for tensile and charpy testing were Brinell tested after heat treatment. The hardness was measured using a digital optical Brinell reader. The tempering response of the invention steel heat treated in the lab can be found in FIG. 2.

Figure 3:
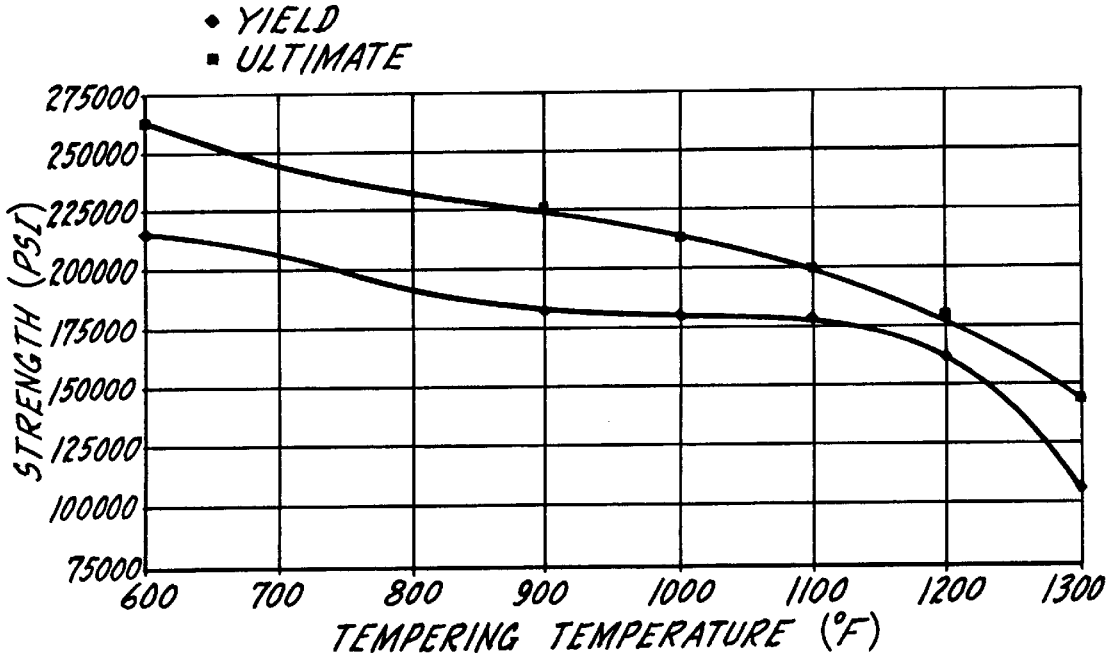
FIG. 3 is a strength versus tempering temperature curve of the invention steel.
Figure 4:
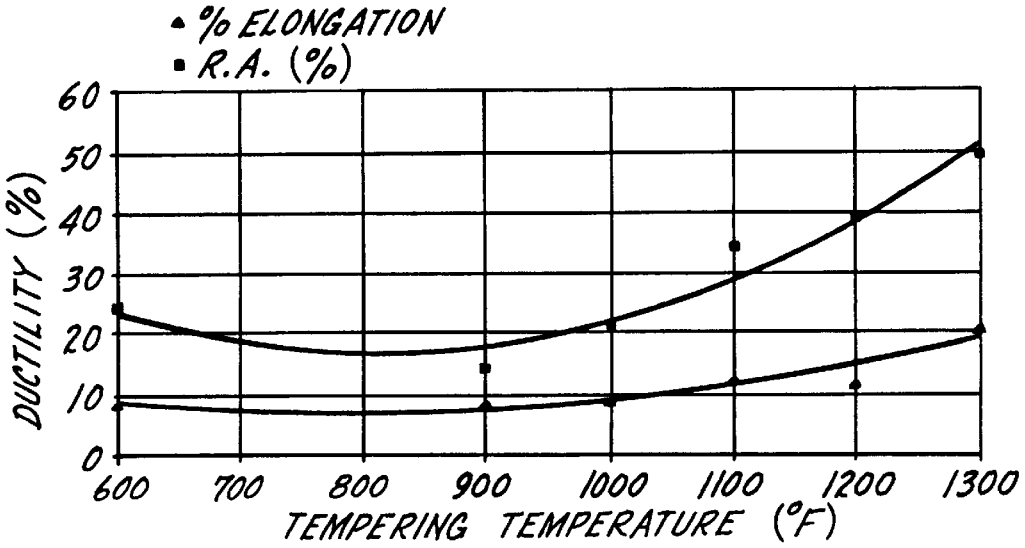
FIG. 4 is a ductility versus temperature curve of the invention steel.
Figure 5:
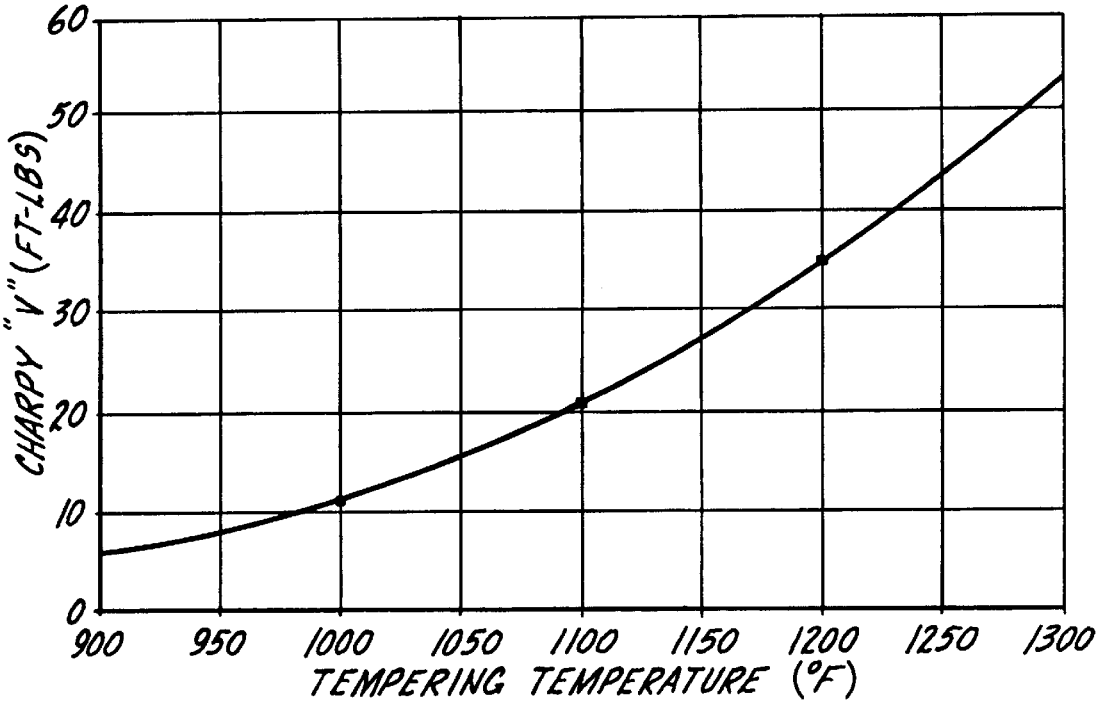
FIG. 5 is a charpy impact versus tempering temperature curve of the invention steel.

The three charpy samples and the six tensile samples were tested for strength and impact toughness. The variation in strength with different tempering temperatures can be found in FIG. 3. The change in ductility with different tempering temperatures can be found in FIG. 4. The change in charpy impact energy with different tempering temperatures can be found in FIG. 5.

Figure 6:
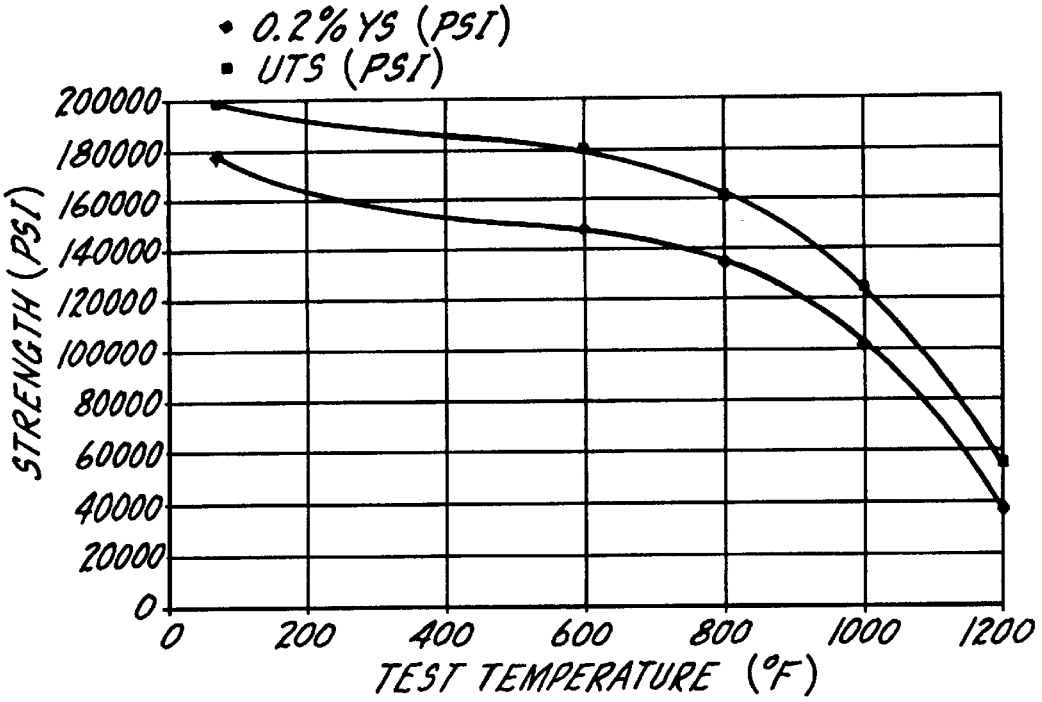
FIG. 6 is a curve of the hot strength of the invention steel tempered at 1100° F.
Figure 7:
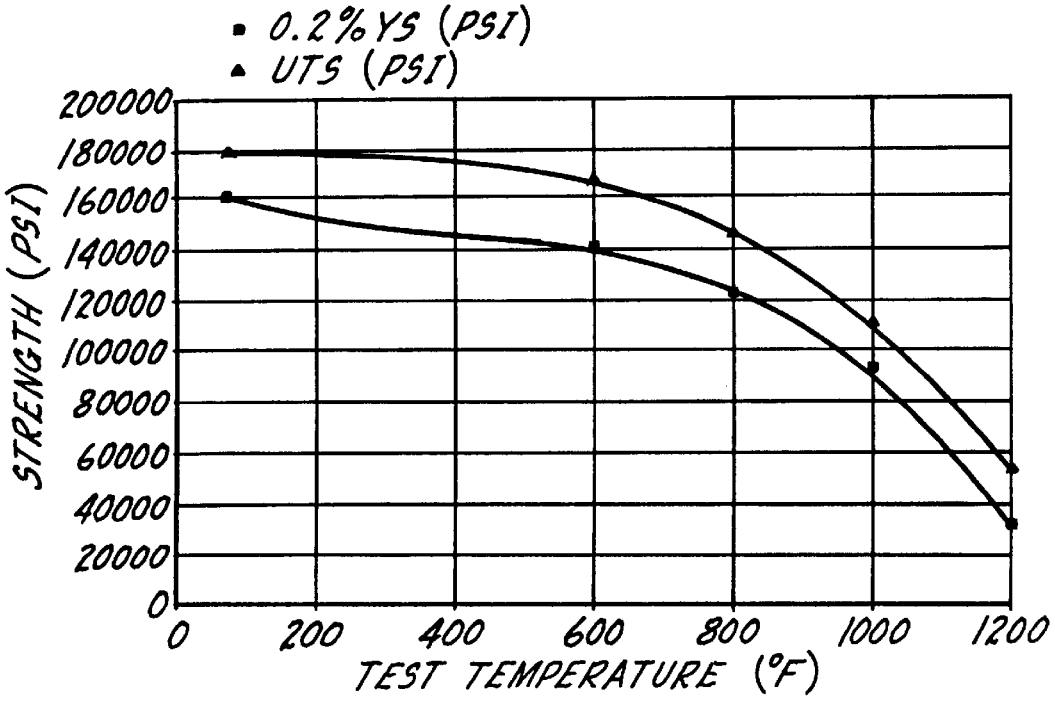
FIG. 7 is a curve of the hot strength of the invention steel tempered at 1200° F.
Figure 8:
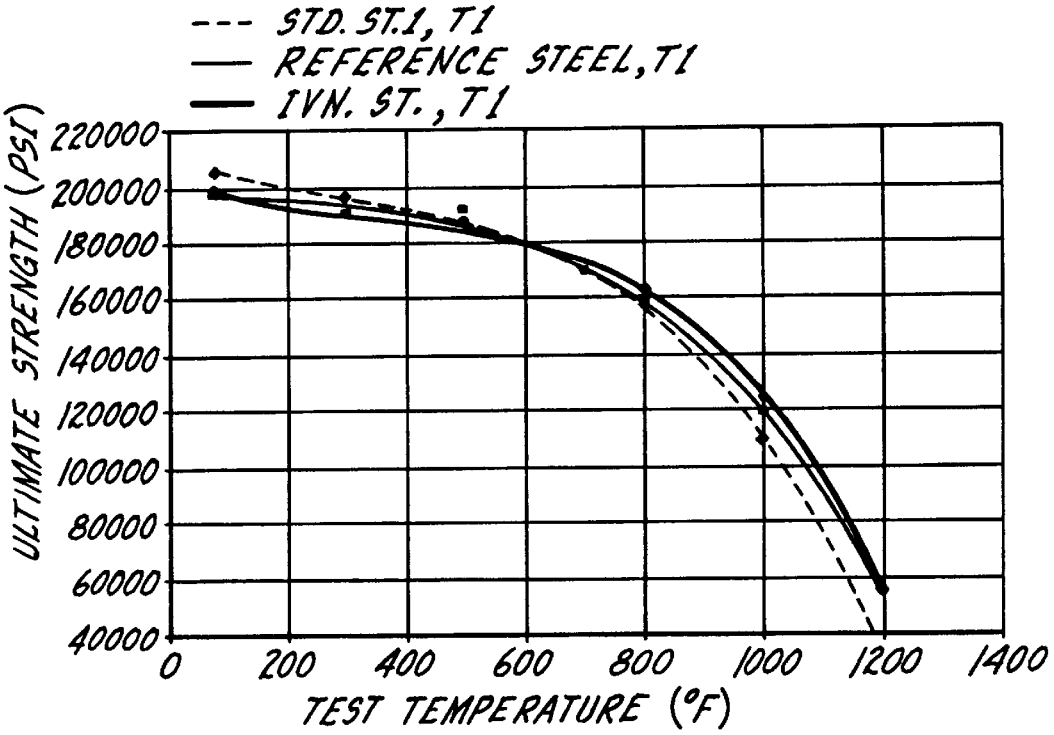
FIG. 8 is a comparison of the hot strength in the temper 1 condition of the invention steel versus the primary reference steel and another standard die steel.
Figure 9:
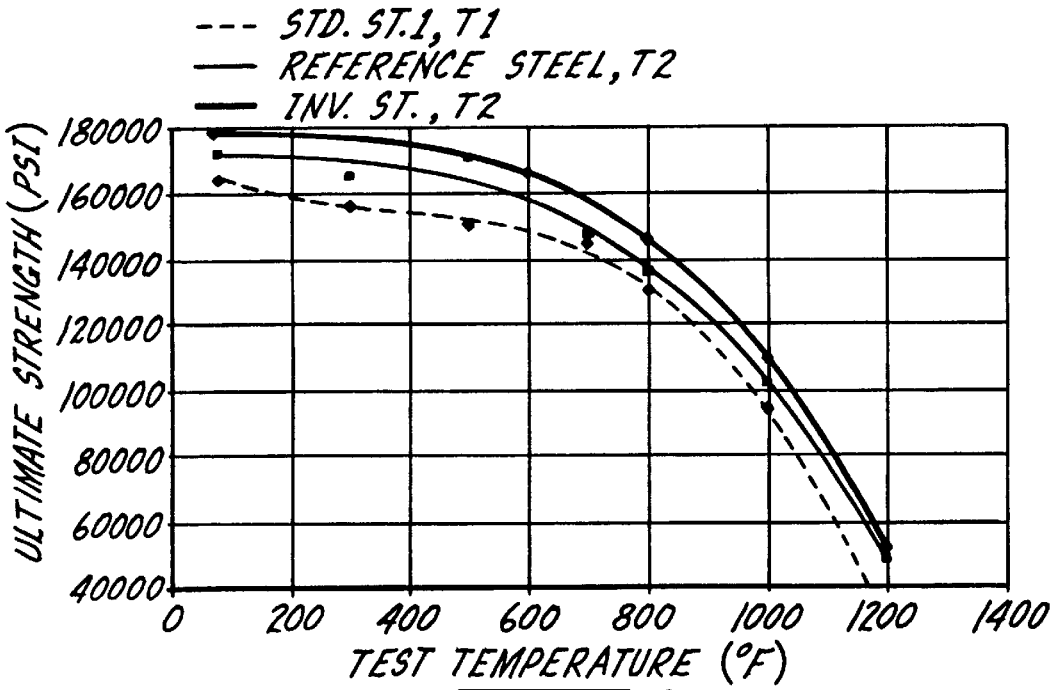
FIG. 9 is a comparison of the hot strength in the temper 2 condition of the invention steel versus the primary reference steel and said other standard die steel.
Figure 10:
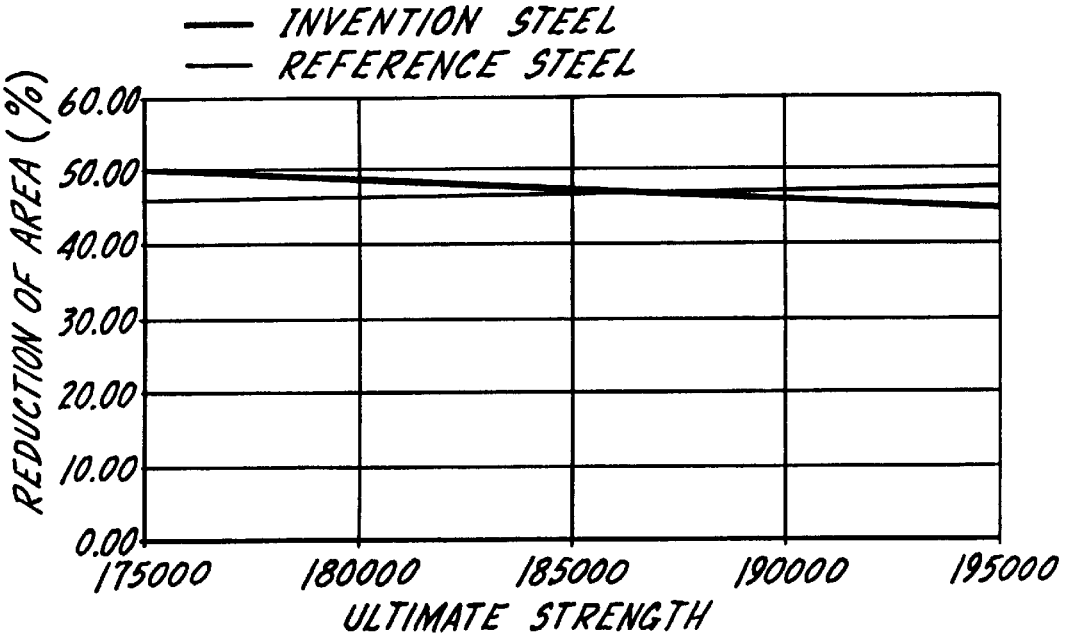
FIG. 10 is a comparison of the reduction in area of the invention steel versus the primary reference steel.
Figure 11:
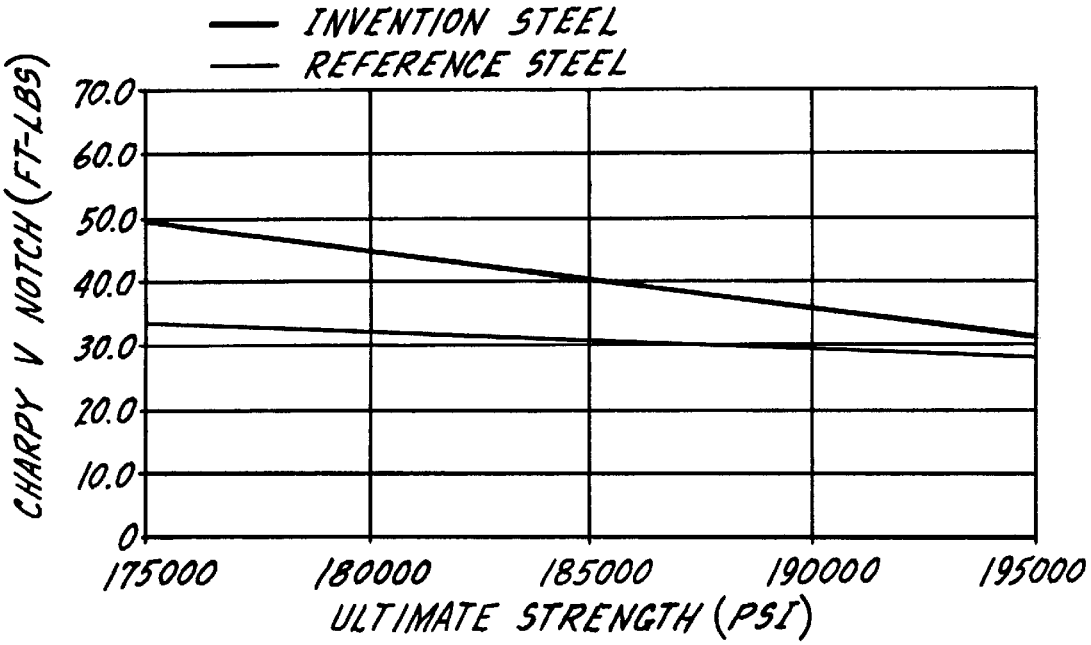
FIG. 11 is a comparison of the charpy V-notch strength of the invention steel versus the primary reference steel.

The four samples quenched and tempered at 1100° F. were hot tensile tested. One sample from each of the tempering temperatures were tested at 600° F., 800° F., 1000° F., and 1200° F. The threaded 0.505 inch diameter specimens were held at testing temperature for 30 minutes before testing. The hot tensile testing results from samples tempered at 1100° F. can be found in FIG. 6. The hot tensile test results from samples tempered at 1200° F. can be found in FIG. 7. A comparison to hot strength of the first standard steel, the primary reference steel, and the invention steel in the Temper 1 condition can be found in FIG. 8. A comparison to hot strength of the first standard steel, the primary reference steel, and the invention steel in the Temper 2 condition can be found in FIG. 9.

The foregoing results indicate that the invention steel is a viable alternative to the primary reference steel in the temper 2 and softer ranges. The impact properties are superior to the first standard steel in the temper 2 hardness range. The hardness drop-off in a 10 inch thickness is approximately 0.05 BID. The tempering response of the invention steel is approximately 30° F. lower tempering temperature for the same hardness as the first standard steel, that is, 1100° F. for the invention steel to achieve temper 2 versus 1130° F. for the first standard steel. This tempering response is even more impressive given the fact that the invention steel has a carbon range of 0.33/0.39 versus 0.48/0.53 for the first standard steel. The strength, ductility, and impact strength of the invention steel is superior to the first standard steel. The hot hardness of the invention steel is superior to the first standard steel and the primary reference steel in Temper 1 and 2 condition. All material properties indicate the invention steel to be a viable alternative to the primary reference steel in temper 2 and softer conditions.

Although the invention has been descried in detail it will at once be apparent to those skilled in the art that modifications can be made within the spirit and scope of the invention. Accordingly, it is intended that the scope of the invention not be limited by the foregoing exemplary description, but rather by the scope of the hereafter appended claims when interpreted in light of the relevant prior art.

We claim:

1. A high strength, wear resistant, tough alloy steel have the following approximate composition:

| | |
|---|---|
| C | .36 |
| Mn | .60 |
| P | .025 |
| S | .025 |
| Si | .50 |
| Ni | 1.20 |
| Cr | 1.50 |
| Mo | .50 |
| Cu | .75 |
| Al | .020 |
| Fe | balance |

2. The alloy steel of claim 1 further characterized in that said steel is in a Temper H or softer condition.

3. A high strength, wear resistant, tough alloy steel having the following composition:

| | |
|---|---|
| C | .33–.39 |
| Mn | .50–.70 |
| P | .025 max. |
| S | .025 max. |
| Si | .40–.60 |
| Ni | 1.05–.135 |
| Cr | 1.33–1.68 |
| Mo | .40–.60 |
| Cu | .60–.90 |
| Al | .010–0.30 |
| Fe | balance |

4. The alloy steel of claim 3 further characterized in that said steel is in a Temper H condition or softer.

5. The alloy steel of claim 4 further characterized in that said steel is manufactured by a process which includes the steps of:

forming a heat containing all of the above identified elements, subjecting said heat to a vacuum sufficiently low to effectively degas the heat, passing a purging agent upwardly through the heat from a location remote from the surface to the surface to thereby set up a circulation to ensure that all regions remote from the surface are subjected to the vacuum during at least a portion of the time the heat is subjected to the vacuum, and subjecting said heat to an alternating current electric heating arc struck directly between non-consumable electrodes and the heat during at least a portion of the time the heat is subjected to the simultaneous effect of the vacuum and the purging agent.

6. The alloy steel of claim 5 further characterized in that the vacuum approaches a magnitude on the order of about 1 mm Hg, or below, during a portion of the time the heat is subjected to vacuum.

7. The alloy steel of claim 6 further characterized in that the final included gas contents of the steel are H-2.2 ppm, O-50 ppm, N-80 ppm, or less.

8. A metal shaping die having the following characteristics:

| | |
|---|---|
| C | .33–.39 |
| Mn | .50–.70 |
| P | .025 max. |
| S | .025 max. |
| Si | .40–.60 |
| Ni | 1.05–1.35 |
| Cr | 1.33–1.68 |
| Mo | .40–.60 |
| Cu | .60–.90 |
| Al | .010–.030 |
| Fe | balance |

and which attains the following characteristics:

388 BHN or less 164,000 Yield Strength, psi 190,000 Ultimate Tensile, psi

45% Reduction of Area 14.5% Elongation

36 Charpy, ft-lbs.

after having been tempered at 1100°–1130° F.

9. The metal shaping die of claim 8 further characterized in that said steel is manufactured by a process which includes the steps of:

forming a heat containing all of the above identified elements, subjecting said heat to a vacuum sufficiently low to effectively degas the heat, passing a purging agent upwardly through the heat from a location remote from the surface to the surface to thereby set up a circulation to ensure that all regions remote from the surface are subjected to the vacuum during at least a portion of the time the heat is subjected to the vacuum, and subjecting said heat to an alternating current electric heating arc struck directly between non-consumable electrodes and the heat during at least a portion of the time the heat is subjected to the simultaneous effect of the vacuum and the purging agent.

10. The metal shaping die of claim 9 further characterized in that the vacuum approaches a magnitude on the order of about 1 mm Hg, or below, during a portion of the time the heat is subjected to vacuum.

11. The metal shaping die of claim 10 further characterized in that the final included gas contents of the steel are H-2.2 ppm, O-50 ppm, N-80 ppm, or less.

12. A high strength wear resistant, tough alloy steel having the following approximate composition:

| | |
|---|---|
| C | .25–.45 |
| Mn | .50–1.50 |
| P | .025 max |
| S | .025 max |
| Si | .30–.70 |
| Ni | .40–1.40 |
| Cr | 1.25–1.75 |
| Mo | .30–.70 |
| Cu | .60–1.50 |
| Al | .010–.10 |
| Fe | balance |

13. The alloy steel of claim 12 further characterized in that said steel is in a Temper H or softer condition.

14. The alloy steel of claim 13 further characterized in that said steel is manufactured by a process which includes the steps of:

forming a heat containing all of the above identified elements, subjecting said heat to a vacuum sufficiently low to effectively degas the heat, passing a purging agent upwardly through the heat from a location remote from the surface to the surface to thereby set up a circulation to ensure that all regions remote from the surface are subjected to the vacuum during at least a portion of the time the heat is subjected to the vacuum, and subjecting said heat to an alternating current electric heating arc struck directly between non-consumable electrodes and the heat during at least a portion of the time the heat is subjected to the simultaneous effect of the vacuum and the purging agent.

15. The alloy steel of claim 14 further characterized in that the vacuum approaches a magnitude on the order of about 1 mm Hg, or below, during a portion of the time the heat is subjected to vacuum.

16. The alloy steel of claim 15 further characterized in that the final included gas contents of the steel are H-2.2 ppm, O-50 ppm, N-80 ppm, or less.

17. A metal shaping tool having the following characteristics:

| | |
|---|---|
| C | .25–.45 |
| Mn | .50–1.50 |

-continued

| | |
|---|---|
| P | .025 max |
| S | .025 max |
| Si | .30–.70 |
| Ni | .40–1.40 |
| Cr | 1.25–1.75 |
| Mo | .30–.70 |
| Cu | .60–1.50 |
| Al | .010–.030 |
| Fe | balance |

388 BHN or less and which attains the following characteristics:

164,000 Yield, psi 190,000 Ultimate Tensile, psi

45% Reduction of Area 14.5% Elongation

36 Charpy, ft-lbs.

after having been tempered at 1100°–1130° F.

18. The metal shaping tool of claim 17 further characterized in that said steel is manufactured by a process which includes the steps of:

forming a heat containing all of the above identified foregoing elements except aluminum, subjecting said heat to a vacuum sufficiently low to effectively degas the heat, passing a purging agent upwardly through the heat from a location remote from the surface to thereby set up a circulation to ensure that all regions remote from the surface are subjected to the vacuum during at least a portion of the time the heat is subjected to the vacuum, and subjecting said heat to an alternating current electric heating arc struck directly between non-consumable electrodes and the heat during at least a portion of time heat is subjected to the simultaneous effect of the vacuum and the purging agent.

19. The metal shaping tool of claim 18 further characterized in that the vacuum approaches a magnitude on the order of about 1 mm Hg, or below, during a portion of the time the heat is subjected to vacuum.

20. The metal shaping tool of claim 18 further characterized in that the final included gas contents of the tool are H-2.2 ppm, O-50 ppm, N-80 ppm, or less.

* * * * *